US006698080B2

(12) United States Patent
Sawajiri et al.

(10) Patent No.: US 6,698,080 B2
(45) Date of Patent: Mar. 2, 2004

(54) STRIKER OF VEHICLE DOOR LATCH MANUFACTURING METHOD

(75) Inventors: Yukio Sawajiri, Yamanashi-ken (JP); Hiroyuki Sakagami, Yamanashi-ken (JP); Miki Ogino, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/232,683

(22) Filed: Sep. 3, 2002

(65) Prior Publication Data

US 2003/0000064 A1 Jan. 2, 2003

Related U.S. Application Data

(62) Division of application No. 10/032,326, filed on Dec. 31, 2001.

(30) Foreign Application Priority Data

Dec. 30, 2000 (JP) ..... 2000-404955

(51) Int. Cl.[7] ..... B21D 39/00
(52) U.S. Cl. ..... 29/509; 29/512
(58) Field of Search ..... 29/509, 512, 520, 29/522.1; 292/340

(56) References Cited

U.S. PATENT DOCUMENTS 4,602,813 A * 7/1986 Gergoe et al. ..... 292/340
5,050,917 A 9/1991 Hamada
5,215,342 A * 6/1993 Yuge et al. ..... 292/340

FOREIGN PATENT DOCUMENTS

GB 2336178 A 10/1999

* cited by examiner

*Primary Examiner*—John C. Hong
(74) *Attorney, Agent, or Firm*—Browdy and Neimark

(57) ABSTRACT

A method for making a striker for a vehicle door latch produces such a striker having a longitudinal plate-like metal base and a U-shaped metal engaging member including a first leg part, a second leg part and a front connecting part. The first leg part has, at a front side portion thereof, a latch engaging part which is engageable with an engaging recess of a latch of the vehicle door latch device. The first leg part has, at a rear side portion thereof, a reinforced large diameter part with a larger diameter than that of the latch engaging part. A length of the reinforced large diameter part is 20% or more in the length of the first leg part.

11 Claims, 2 Drawing Sheets

STRIKER OF VEHICLE DOOR LATCH MANUFACTURING METHOD

This is a division of copending parent application Ser. No. 10/032,326, filed Dec. 31, 2001.

FIELD OF THE INVENTION

The present invention relates to a striker of a vehicle door latch device and a manufacturing method thereof.

DESCRIPTION OF THE RELATED ART

The conventional and typical striker which is engaged with a latch of a door latch device to keep a vehicle door in the closed state, comprises, a metal base, and a U-shaped metal rod fixed to the base by caulking work or the like. The diameter of the metal rod is generally about 7 mm. A rod thinner than that of 7 mm brings insufficiency in strength of the striker, and a rod thicker than that of 7 mm makes the latch which has an engaging recess to be engaged with the rod large-sized. The large sized latch requires a large and heavy housing of the door latch device.

In U.S. Pat. No. 5,050,917, a striker having a U-shaped reinforced metal rod is described. The reinforced rod comprises an engaging leg part with a normal diameter which is engageable with the latch, a support leg part with a large diameter which is disengageable with the latch, and a large diameter connecting part which connects the respective outsides of the engaging leg part and the support leg part. The reinforced metal rod has succeeded in improvement of the strength of the striker without making the latch large-sized.

However, in the case of the above described reinforced rod, the manufacturing cost is high. In the case of the normal type striker made of a linear rod which has the same diameter from beginning to end, it can easily be formed in such a way where a linear rod is bent and shaped like a "U", and after that, one pair of ends are fixed to the base by caulking work or the like, and therefore, the manufacturing cost is low. But in the case of the reinforced type striker, it is difficult to form that by a linear rod which has the same diameter from beginning to end, and the number of manufacturing processes is increased, and the cost rising is inevitable.

SUMMARY OF THE INVENTION

Accordingly, it is an object of the present invention to provide a striker which has a reinforced type rod, and which can easily be manufactured.

DESCRIPTION OF THE PREFERRED EMBODIMENTS

Figure 1:
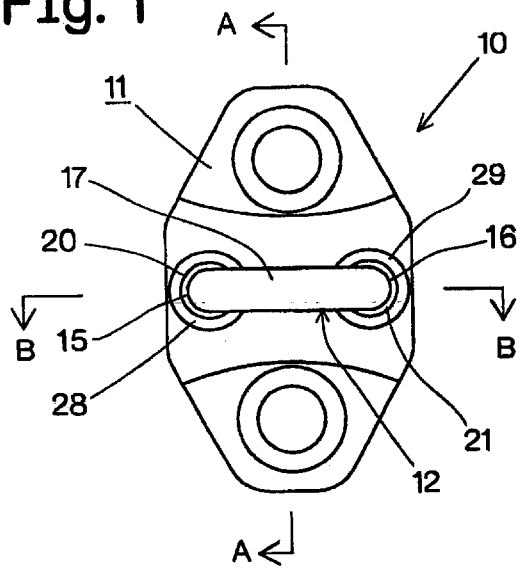
FIG. 1 is a front view of a striker according to the present invention.
Figure 2:
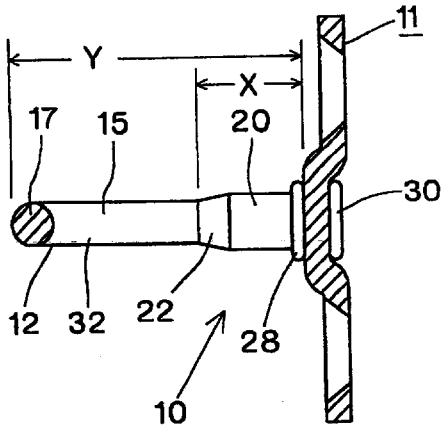
FIG. 2 is the A—A cross sectional view of FIG. 1.
Figure 3:
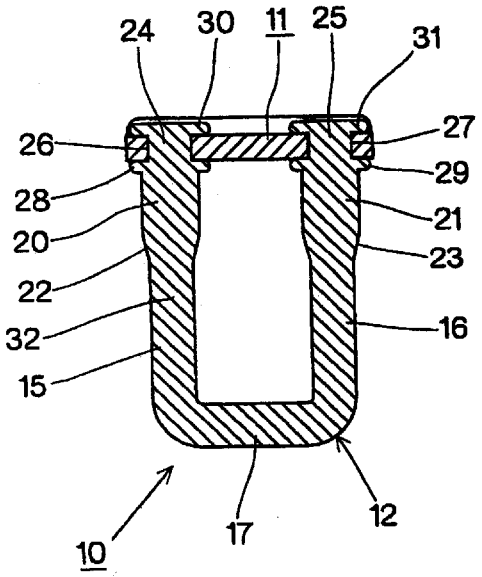
FIG. 3 is the B—B cross sectional view of FIG. 1.
Figure 4:
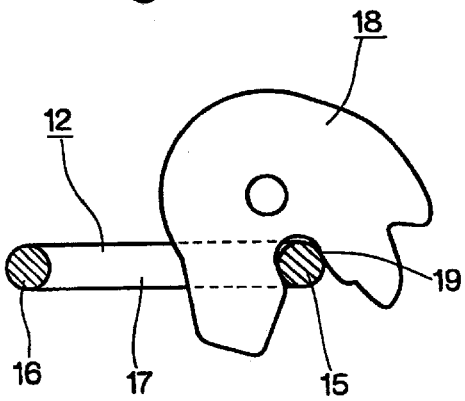
FIG. 4 is a schematic drawing showing the relation between the striker and a latch.
Figure 5:
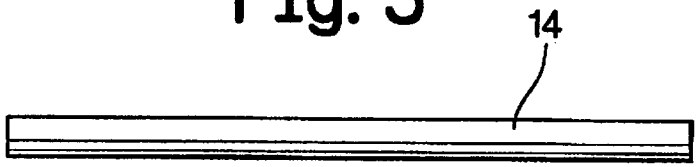
FIG. 5 is a plan view of a metal linear rod.
Figure 6:
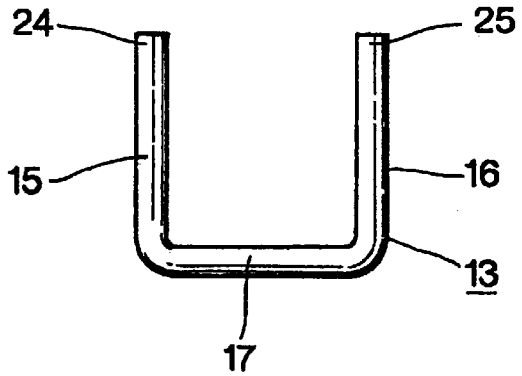
FIG. 6 is a plan view of a U-shaped rod.

A striker 10 according to the present invention has a longitudinal plate-like metal base 11 which is fixed to a vehicle body (not shown in the figure) by a bolt or the like, and an approximately U-shaped engaging member 12 which is fixed to the base 11. A linear metal rod 14 (FIG. 5) which is used as the material of the engaging member 12 preferably has a round cross section with the same diameter at any portion, and first of all, it is cut to have a predetermined length. The cut linear rod 14 is bent by press work or the like, and is formed to be a U-shaped rod 13 which is composed of a first leg part 15 as an engaging side, a second leg part 16 as a support side, and a front connecting part disposed between the front end of the first leg part 15 and the front end of the second leg part 16. The first leg part 15 is, as shown in FIG. 4, engageable with an engaging recess 19 of a latch 18 of a vehicle door latch device to be attached to a vehicle door.

Figure 7:
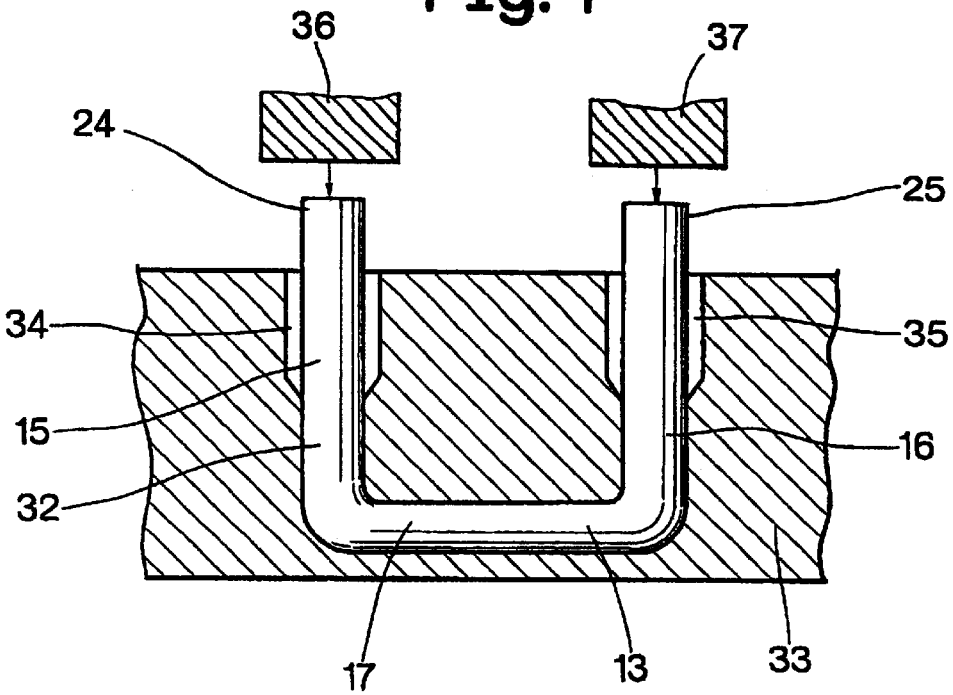
FIG. 7 is a cross sectional view showing the U-shaped rod and a press lower die.

The first leg part 15 as a final product has a first reinforced large diameter part 20 at the rear side portion thereof, and similarly, the second leg part 16 has a second reinforced large diameter part 21. As shown in FIG. 7, the reinforced large diameter parts 20 and 21 are formed by press work. The U-shaped rod 13 is set in a press lower die 33 in the state where rear ends 24 and 25 of the leg parts 15 and 16 project upward from the press lower die 33. The press lower die 33 has large cavities 34 and 35 corresponding to the reinforced large diameter parts 20 and 21. When pressing the rear ends 24 and 25 which project from the press lower die 33 are pressed by press bars 36 and 37, the rear side portions of the leg parts 15 and 16 are swelled in the radial direction to form the reinforced large diameter parts 20 and 21. The reinforced large diameter parts 20 and 21 preferably have front tapered parts 22 and 23.

The rear ends 24 and 25 of the leg parts 15 and 16 are inserted into mounting holes 26 and 27 formed in the base 11, and after that, they are fixed to the base 11 by the front caulking flanges 28 and 29 and the rear caulking flanges 30 and 31. The front caulking flanges 28 and 29 are preferably formed before inserting the rear ends 24 and 25 into the mounting holes 26 and 27.

The first leg part 15 has a latch engaging part 32 engageable with the engaging recess 19 of the latch 18. The latch engaging part 32 is positioned on the front side of the first reinforced large diameter part 20 (tapered part 22), and the diameter of the latch engaging part 32 is the same as the diameter of the linear rod 14.

It is desirable that the length X of the first reinforced large diameter part 20 including the tapered part 22 and front flange 28 is 20% or more of the length Y of the first leg part 15.

Advantageous Effect of the Invention

The U-shaped rod 13 of the present invention can be formed by bending a linear metal rod 14 which has the same diameter from beginning to end, and therefore, it can be manufactured easily and at a low cost.

The reinforced large diameter parts 20 and 21 can be formed easily and at a low cost by press work.

The combination of the reinforced large diameter part 20 and the latch engaging part 32 having the same diameter as the linear rod 14 improves the strength of the striker 10 without making the latch of the door latch device large-sized.

What is claimed is:

1. A manufacturing method of a striker of a vehicle door latch device, comprising:

bending a linear metal rod with a same diameter from beginning to end to form a U-shaped rod including a first leg part, a second leg part which is in parallel with said first leg part, and a front connecting part which connects a front end of said first leg part and a front end of said second leg part;

setting said U-shaped rod in a press lower die having a cavity whose diameter is larger than the diameter of said linear metal rod, in a state where rear ends of said first and second leg parts project outward from the press lower die;

pressing the rear ends of said first and second leg parts by press bars to form reinforced large diameter parts whose diameter is larger than the diameter of said linear metal rod, at rear side portions of said first and second leg parts which are positioned in said cavity, without changing the diameter of front side portions of said first and second leg parts; and inserting said rear ends of said first and second leg parts into mounting holes of a metal base, and after that, fixing said rear ends to said metal base with a caulking flange.

2. The method of claim 1 carried out to produce a length of said reinforced large diameter part which is at least 20% of a length of the first leg part.

3. The method of claim 1 wherein said bending is carried out to provide said second leg part with a same shape as said first leg part.

4. The method of claim 1 carried out to provide a latch engaging part with the same diameter as said front connecting part.

5. The method of claim 4 carried out to provide a tapered part between said reinforced large diameter part and said latch engaging part.

6. The method of claim 1 carried out to provide a length of said reinforced large diameter part which is at least 25% more than a length of said first leg part.

7. The method of claim 4 carried out to provide said-second leg part with a same shape as said first leg part and with said latch engaging part having the same diameter as said front connecting part, and further to provide a tapered part between said reinforced large diameter part and said latch engaging part.

8. The method of claim 7 carried out to provide the length of said reinforced large diameter part at least 25% more than a length of said first leg part.

9. The method of claim 1 carried out to provide the length of said reinforced large diameter part at least 30% more than a length of said first leg part.

10. The method of claim 1 carried out to provide said reinforce large diameter part with a length of at least twice a length of rear caulking flange, in a longitudinal direction of said first leg part.

11. The method of claim 1 carried out to provide said reinforce large diameter part with a length of at least three times a length of said rear caulking flange, in a longitudinal direction of said first leg part.

* * * * *